US008884198B2

(12) United States Patent
Czimmek

(10) Patent No.: US 8,884,198 B2
(45) Date of Patent: Nov. 11, 2014

(54) PARAMETRIC TEMPERATURE REGULATION OF INDUCTION HEATED LOAD

(75) Inventor: Perry R. Czimmek, Williamsburg, VA (US)

(73) Assignee: Continental Automotive Systems, Inc., Auburn Hills, MI (US)

( * ) Notice: Subject to any disclaimer, the term of this patent is extended or adjusted under 35 U.S.C. 154(b) by 1086 days.

(21) Appl. No.: 12/691,810

(22) Filed: Jan. 22, 2010

(65) Prior Publication Data

US 2011/0180624 A1 Jul. 28, 2011

(51) Int. Cl.

| | |
|---|---|
| ***H05B 6/10*** | (2006.01) |
| ***H05B 6/08*** | (2006.01) |
| ***F02D 1/06*** | (2006.01) |
| ***B05B 1/24*** | (2006.01) |
| ***B05C 1/00*** | (2006.01) |
| ***F02M 53/06*** | (2006.01) |
| ***F02M 57/00*** | (2006.01) |

(52) U.S. Cl.

CPC ..... *F02M 53/06* (2013.01); *F02M 57/005* (2013.01)

USPC ..... 219/628; 219/664; 219/665; 239/5; 239/133; 239/135

(58) Field of Classification Search

USPC ..... 219/660, 661, 663, 665, 664, 667, 627, 219/628; 239/5, 133, 135, 128, 585.1, 239/584.4, 136, 138, 139; 123/205, 220, 123/261, 264, 275, 276, 294, 338, 406.47, 123/445, 472, 478, 490

See application file for complete search history.

(56) References Cited

U.S. PATENT DOCUMENTS

| | | | |
|---|---|---|---|
| 4,074,215 | A | 2/1978 | Rollett |
| 4,353,044 | A | 10/1982 | Nossek |
| 4,364,116 | A | 12/1982 | Nossek |
| 4,812,785 | A | 3/1989 | Pauker |
| 4,885,528 | A | 12/1989 | Tanaka et al. |
| 4,992,740 | A | 2/1991 | Wakasugi |
| 5,159,915 | A | 11/1992 | Saito et al. |

(Continued)

FOREIGN PATENT DOCUMENTS

| | | | |
|---|---|---|---|
| CN | 101421505 | A | 4/2009 |
| DE | 102007009428 | A1 | 10/2007 |

(Continued)

OTHER PUBLICATIONS

International Preliminary Report on Patentability from corresponding International Patent Application No. PCT/US2011/021836, dated Jul. 24, 2012.

(Continued)

*Primary Examiner* — Henry Yuen
*Assistant Examiner* — Hung D Nguyen

(57) ABSTRACT

A fuel delivery system for a vehicle includes a fuel injector that dispenses heated fuel flow and controls the temperature of the heated fuel within a desired temperature range. Fuel flowing through the example fuel injector is inductively heated by a valve element sealed with the fuel flow. A driver controller detects changes in temperature by monitoring changes in parameters that vary responsive to temperature in the material of the heated element. Changes in the material responsive to temperature are utilized to tailor input into the heated element to maintain a desired temperature of the heated element and thereby the temperature of the fuel.

6 Claims, 4 Drawing Sheets

(56) References Cited

U.S. PATENT DOCUMENTS

| | | | | |
|---|---|---|---|---|
| 5,235,223 | A | 8/1993 | Maple | |
| 5,600,288 | A | 2/1997 | Liu | |
| 5,825,265 | A | 10/1998 | Fujii | |
| 6,665,403 | B1 | 12/2003 | Fischer et al. | |
| 6,888,938 | B2 | 5/2005 | Cui et al. | |
| 7,107,976 | B2 * | 9/2006 | Gu | 123/644 |
| 7,477,187 | B2 | 1/2009 | Rofougaran | |
| 2004/0000296 | A1 | 1/2004 | Linna et al. | |
| 2007/0200006 | A1 | 8/2007 | Czimmek | |
| 2007/0235557 | A1 * | 10/2007 | Hornby et al. | 239/135 |
| 2009/0145491 | A1 * | 6/2009 | Hlousek et al. | 123/549 |
| 2010/0133363 | A1 | 6/2010 | Imoehl | |
| 2010/0176759 | A1 * | 7/2010 | North | 318/473 |

FOREIGN PATENT DOCUMENTS

| | | | |
|---|---|---|---|
| EP | 1867866 | A2 | 12/2007 |
| JP | 0528813 | A | 11/1993 |
| JP | 2002180919 | A | 6/2002 |
| WO | 2007112462 | A1 | 10/2007 |

OTHER PUBLICATIONS

International Search Report from corresponding International Patent Application No. PCT/US2011/021836, dated Mar. 31, 2011.

* cited by examiner

PARAMETRIC TEMPERATURE REGULATION OF INDUCTION HEATED LOAD

BACKGROUND

This disclosure generally relates to fuel injectors including a heating element for pre-heating fuel prior to combustion. More particularly, this disclosure relates to a method and device for sensing and regulating a temperature of a heating element for a fuel injector.

Pre-heating fuel prior to being injected into a combustion chamber provides a more complete and efficient combustion that both increases fuel efficiency while reducing the production of undesired emission byproducts. Fuel injectors preheat the fuel by exposing fuel flow through the fuel injector to a heating element. The temperature of the fuel is desired to be within a desired range upon exit of the fuel injector and entrance to the combustion chamber. Fuel that is not heated sufficiently does not provide full scale of desired benefits, where fuel that is excessively heated can result in undesirable build up within the fuel system. For these reasons, the temperature of the fuel is sensed and regulated. Typically a temperature sensor is provided within the fuel injector to sense fuel temperature. Such wired sensors required additional circuitry and control at an added cost. Accordingly, it is desirable to design and develop a method and device of sensing temperature that is more efficient.

SUMMARY

A disclosed example fuel delivery system for a vehicle includes a fuel injector that dispenses heated fuel flow and controls the temperature of the heated fuel within a desired temperature range.

Fuel flowing through the example fuel injector is inductively heated by a valve element sealed with the fuel flow. The temperature of the heated valve element is monitored without wires or external sensors. The example driver circuit monitors a material parameter that changes the materials inductance in response to changes in temperature. The driver circuit detects the changes in inductance and changes power input into the heated element responsive to the detected temperature. The temperature of fuel provided to an engine is therefore maintained within a desired temperature range to provide a desired performance.

The driver circuit detects changes in temperature by monitoring changes in parameters that vary responsive to temperature in the material of the heated element. Changes in material permeability caused by changes in temperature cause a proportional change in parameters responsive to changes in inductance. In one example, frequency is detected and utilized to correct power input into the heated element to increase, decrease or maintain a desired temperature of the inductively heated valve element and thereby control of fuel temperature.

These and other features disclosed herein can be best understood from the following specification and drawings, the following of which is a brief description.

DISCLOSURE

This disclosure is submitted in furtherance of the constitutional purposes of the U.S. Patent Laws 'to promote the progress of science and useful arts" (Article 1, Section 8).

Figure 1:
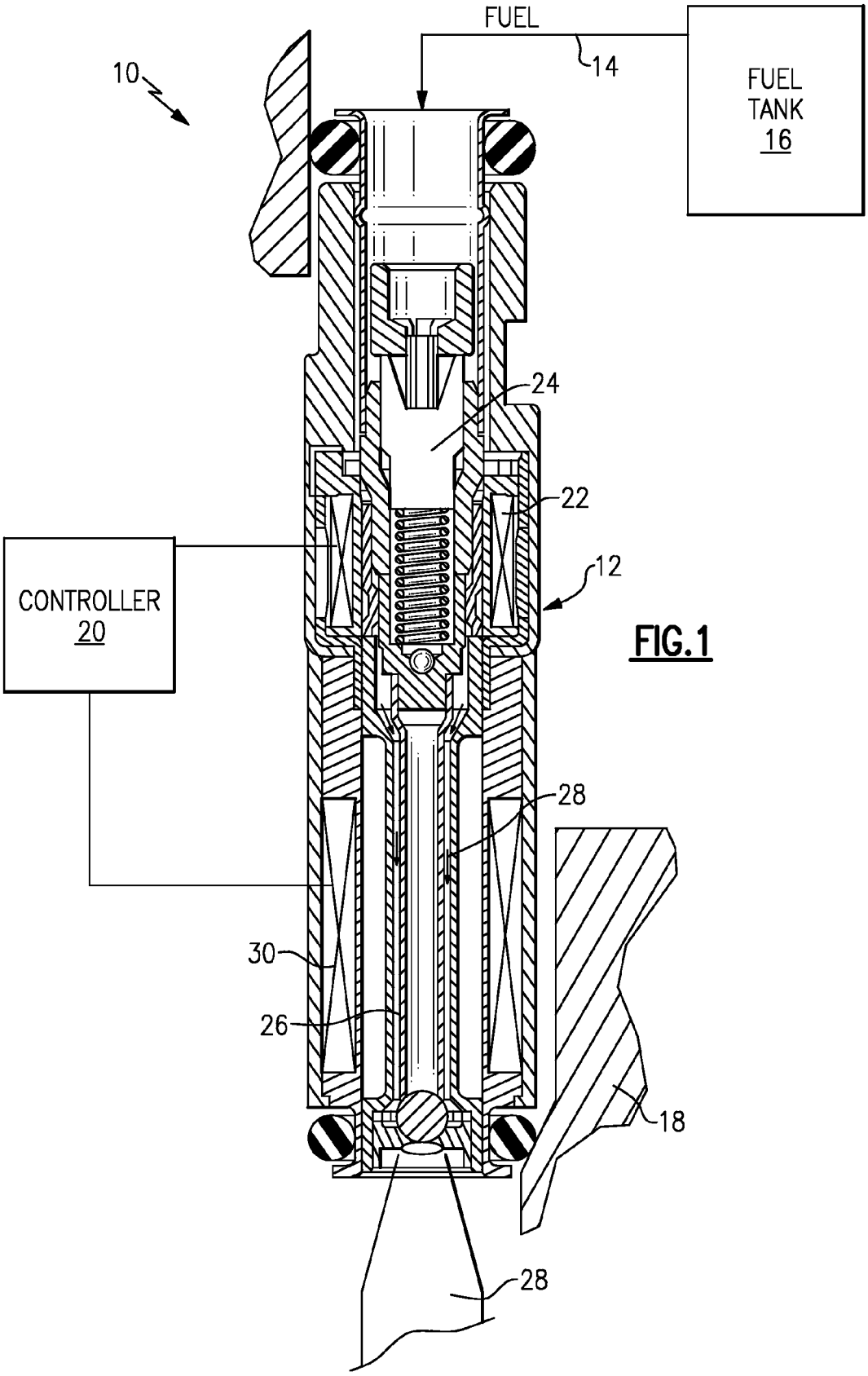
FIG. 1 is a schematic view of an example fuel system including an inductively heated fuel injector.

Referring to FIG. 1, an example fuel delivery system 10 for a vehicle includes a fuel injector 12 that meters fuel flow 14 from a fuel tank 16 to an engine 18. Operation of the fuel injector 12 is governed by a controller 20. The controller 20 selectively powers a driver coil 22 to control movement of an armature 24. Movement of the armature 24 controls the fuel flow 14 through internal passages of the fuel injector 12.

The example fuel injector 12 provides for pre-heating fuel to aid combustion. A heater coil 30 generates a time varying magnetic field in a heated element 26. In this example the heated element 26 is a valve element that is sealed within the fuel flow 14 through the fuel injector 12. There are no wires attached to the heated element 26. Heating is accomplished by coupling energy through the time varying magnetic field produced by the heater coil 30. Energy produced by the heater coil 30 is converted to heat within the sealed chamber of the fuel injector 12 by hysteretic and eddy current loses in the heated element material. The heated element 26 transfers heat to the fuel flow 14 to produced a heated fuel flow 28 that is injected into the engine 18. The heated fuel flow 28 improves cold starting performance and improves the combustion process to reduce undesired emissions.

The temperature of the heated fuel 28 is controlled within a desired temperature range to provide the desired performance. A temperature that is low will not provide the desired benefits. A temperature that is higher than desired can cause undesired damage and also result in deposit formation within the fuel injector.

The example fuel delivery system 10 includes a method and circuit that provides for the determination and control of the temperature of the heated element 28 without the use of temperature sensors, or any other sensors installed within the sealed fuel flow.

Figure 2:
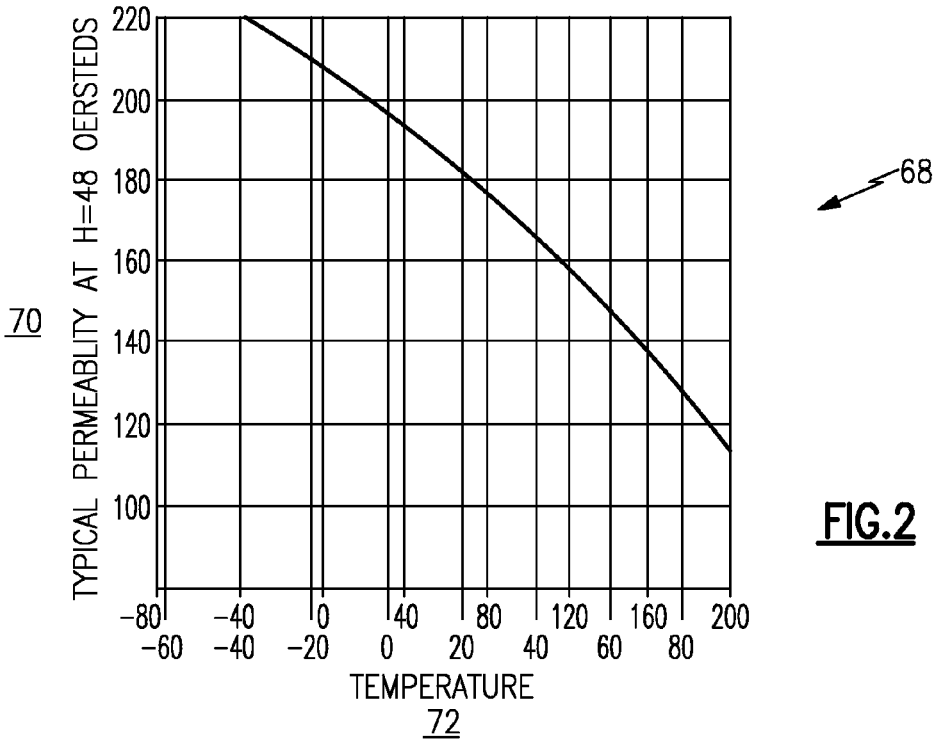
FIG. 2 is a graph illustrating a relationship between temperature and permeability.

Referring to FIG. 2, Ferromagnetic materials exhibit a magnetization or magnetic permeability response to temperature that results in some change in induction, B, according to a known relationship:

$$B=uH,$$

where u is permeability and H is magnetomotive force.

Changes in induction may be non-linear, non-monotonic in the case of a Neel temperature and Curie temperature demagnetization, with ferromagnetism between these two temperatures. Further, the change in induction could be linear, as is illustrated in Graph 68, or at least monotonic from strong ferromagnetism at a low temperature and reduced ferromagnetism at higher temperature. The graph 68 illustrates a relationship between permeability 70 and temperature 72. With the known relationship for a specific material the temperature of an induced element such as the example heated element 28 can be determined.

Figure 3:
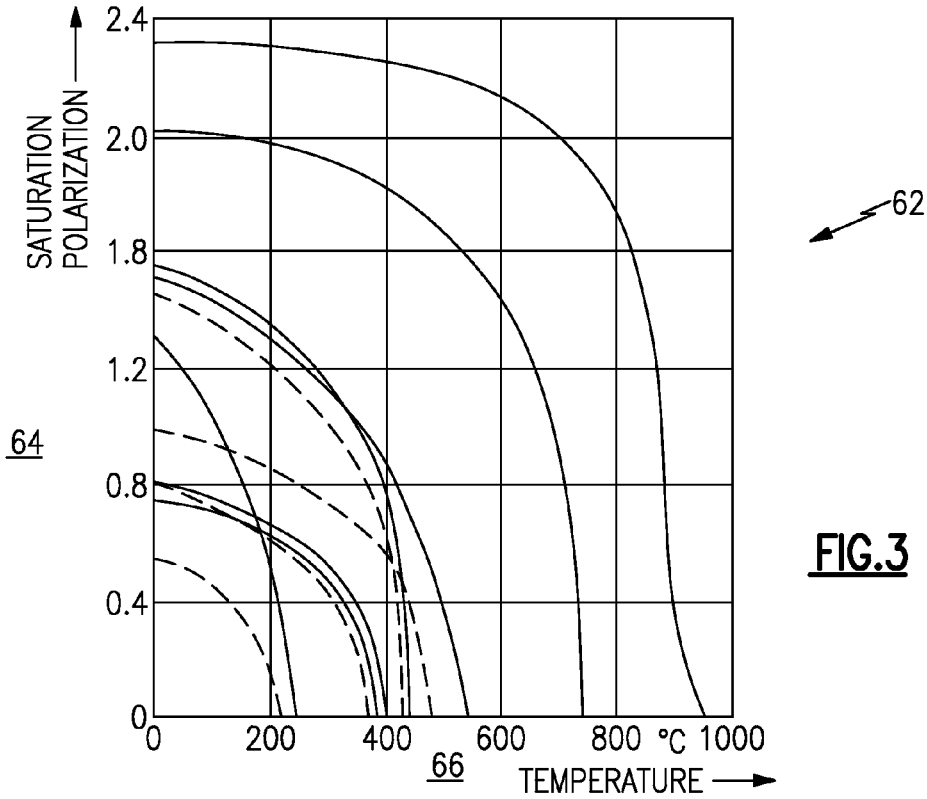
FIG. 3 is a graph illustrating the relationship between temperature and material properties.

Referring to FIG. 3, graph 62 illustrates the relationship between magnetic saturation 64 and temperature 66 for many different materials. The relationships illustrated by graph 62 are used by the example method and circuit to determine a temperature of the heated element. As is illustrated, many different magnetic materials can be used as a heated element 26 and provide a known relationship utilized to determine and control a desired temperature.

Accordingly, the example fuel system 10 measures induction as a parameter that changes responsive to changes in temperature.

Induction is a parameter that causes measurable changes in frequency and phase changes. Frequency is related to inductance according to the equation:

$$fr=1/(2\pi\sqrt{LC})$$

where L is inductance, the measure of induction, or slope of B plotted against H; and C is capacitance.

The example fuel delivery system 10 includes a circuit 32 (FIG. 4) that utilizes the changes of frequency changes due to inductance changes, as a control parameter to determine a change in temperature. Alternatively, phase between current and voltage can also be utilized as the desired control parameter. Current lags voltage less as the inductance decreases, ultimately being in perfect phase with no inductance, or reversing with current leading voltage in the case of a capacitor. The impedance decreases with less inductance, which affects reactive power and will increase current at a given voltage or decrease voltage needed to maintain a given current in the inductor. Therefore, the control parameters of frequency, phase and impedance can be utilized to determine a change of induction as a result of a change of temperature. Any of these can be utilized in the example fuel delivery system 10 to detect and control temperature of the heated element 26.

Figure 4:
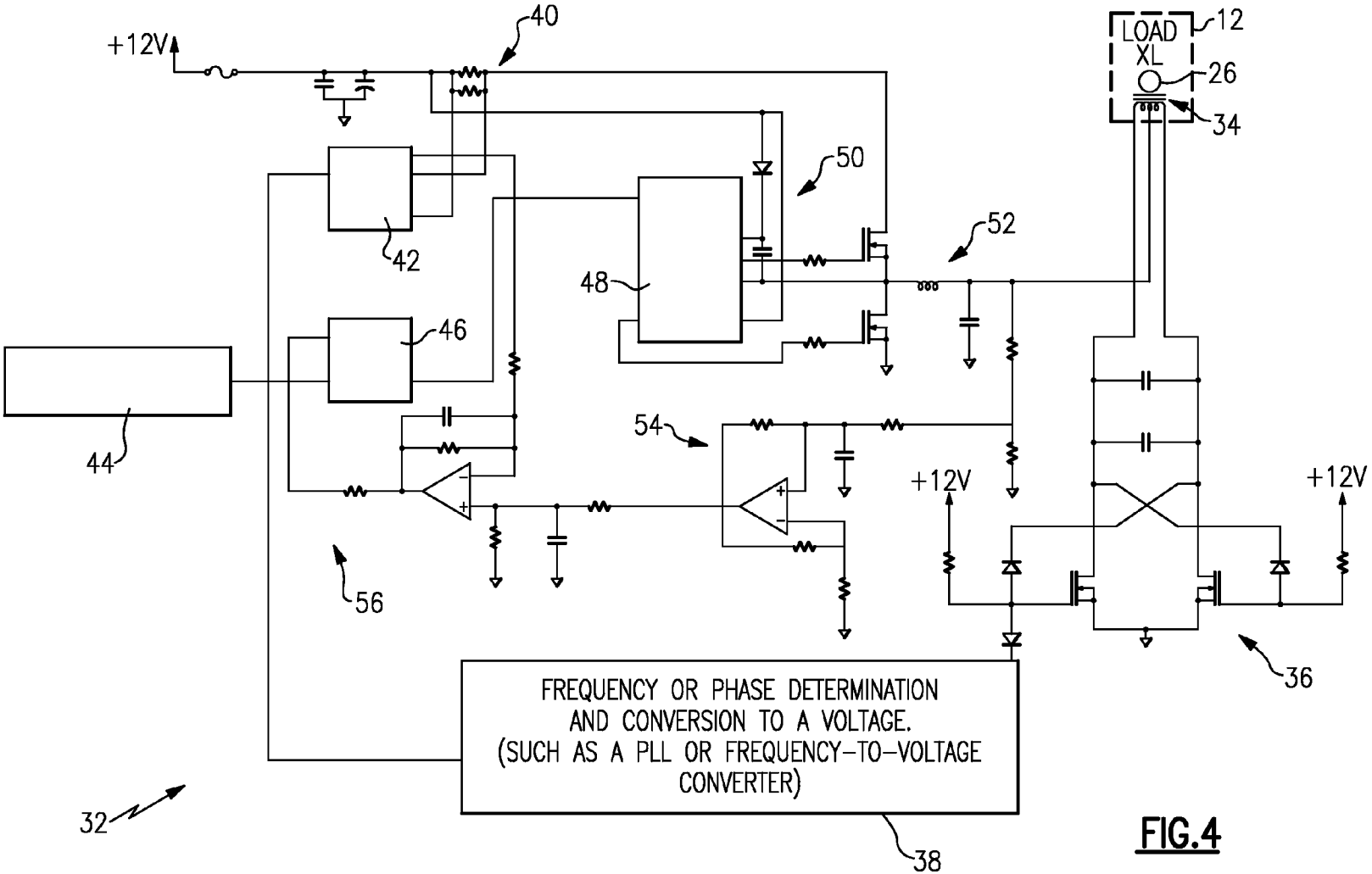
FIG. 4 is a schematic view of an example fuel injector driver circuit.

Referring to FIG. 4, the example circuit 32 utilizes a change in frequency to determine a change in induction and therefore temperature. The example circuit 32 schematically illustrates a portion of driver electronics of the controller 20. A zero-voltage switching power oscillator 36 drives the heating coil or inductive load 34 in the example circuit 32. The power oscillator 36 is regulated in response by the example circuit 32. However, other oscillator configurations such as for example, a hard-switching oscillator or other known driver circuit could be substituted for this circuit without being outside the scope of this invention.

Frequency or phase is determined from measuring a frequency-dependent variable of the oscillator 36. In this example gate voltage is measured from one side of the push-pull oscillator 36 because gate voltage changes directly with frequency. The frequency or phase is thereby converted to a conveniently measured output such as voltage as schematically indicated at 38.

Current into the oscillator 36 is monitored via a current-sense resistor 40 (R1 in parallel with R2). The measured current from the current-sense resistor 40 is differentially amplified to provide a useful value. That value is then multiplied by the frequency scaled voltage in an analog computational engine 42. The result is a frequency-corrected current that is represented by a voltage. The voltage is then differentially amplified relative to a target current value in a current error amplifier 56 set by a voltage integrator 54.

This conditioning of the frequency senses changes and transforms the detected changes in frequency into signals that control the power sent to the load 26 by the oscillator 36. In this example, if the frequency increases (indicating an increase in temperature), then the current sense voltage is multiplied to a higher value that looks like a higher current to the current error amplifier 56, which causes output of a lower error voltage that in turn commands a lower current.

The error voltage is compared to a generated triangle wave from generator 44 utilized in a PWM (Pulse Width Modulation) circuit portion that includes comparator 46 and PWM gate driver 48 to create a PWM waveform that represents the determined current. The determined current provides the power fed to the power oscillator 36 that is responsive to the detected changes in frequency, and inductance to controls generation of heat in the heated element 28.

Figure 5:
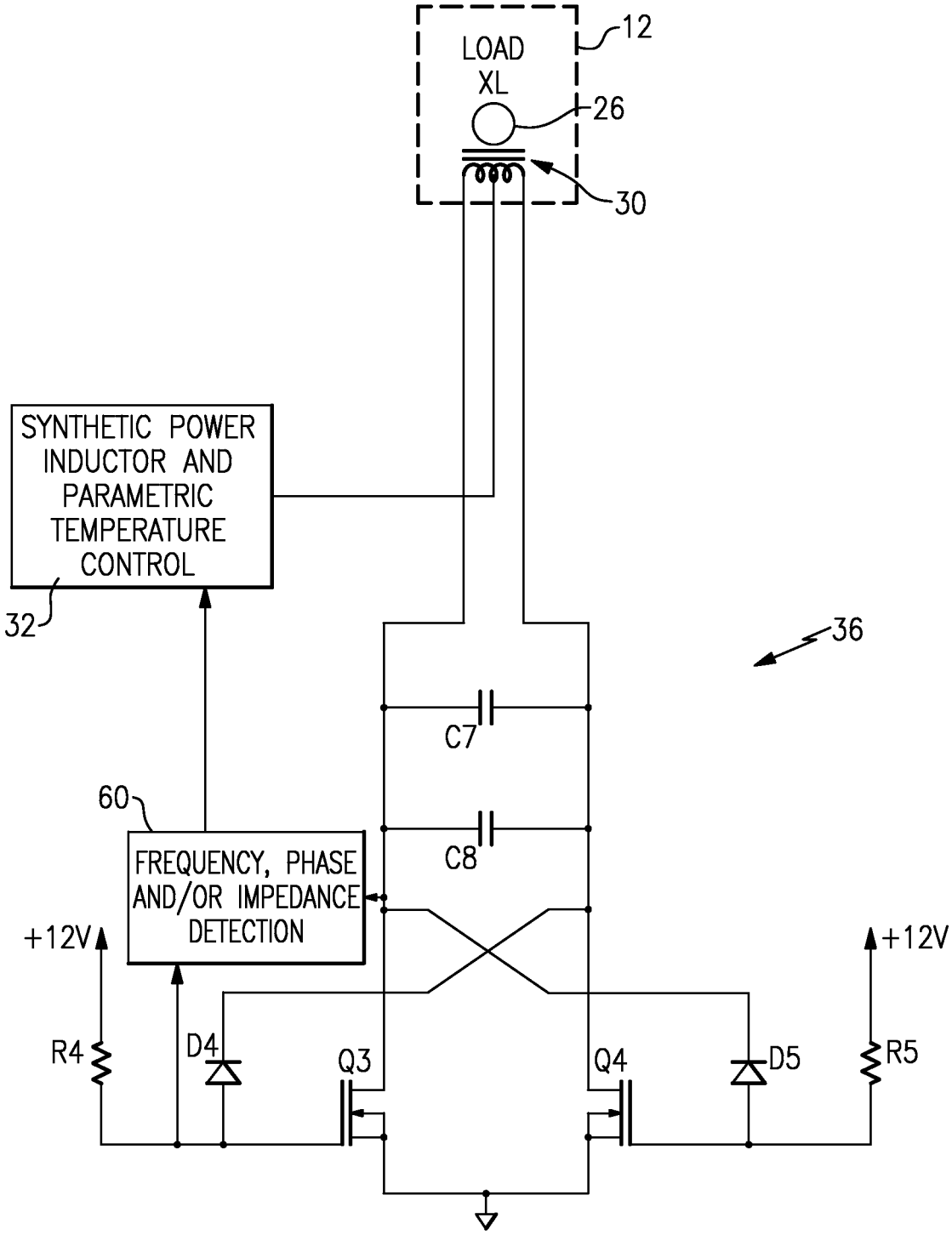
FIG. 5 is a schematic view of an example inductive heating circuit.

Referring to FIG. 5, the example circuit 32 utilizes the current sense and error 40, voltage integrator 54, current error amplifier 56, PWM comparator 46, PWM gate driver 48, class-D Amplifier Bridge 50, and carrier filter 52, together to form a synthetic power inductor that provides parametric temperature control that is schematically indicated by block 58. This example circuit schematic illustrates that frequency, phase and/or impedance detection are utilized to enable a parametric temperature control by varying the virtual loss of the synthetic power inductor 58 that controls the power replenishment available to the power oscillator 36.

Accordingly, the example circuit 32 detects changes in temperature by monitoring changes in parameters that vary responsive to temperature in the magnetic material of the heated element. Changes in material permeability caused by changes in temperature cause a proportional change in parameters responsive to changes in inductance. In the example, frequency is detected and utilized to correct power input into the inductive load to reduce, increase or maintain a desired temperature of the inductively heated element 28, and thereby control of fuel temperature.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A heated fuel injector driver circuit assembly comprising:

an inductor, configured to provide a time varying magnetic field to a heating element, wherein the heating element is within a fuel flow and separate from the inductor;

a monitor that senses energy supplied to the inductor and provides a first output voltage value, the energy supplied to the inductor being provided by an oscillator coupled to said inductor;

a converter that converts a frequency that changes responsive to changes in temperature of the heating element into a second output voltage value;

a computational engine that combines the first output voltage value and the second output voltage value to obtain a scaled voltage value;

an error amplifier that combines the scaled voltage value with a target value to obtain an error value;

a comparator that compares the error value to a periodic waveform to adjust power provided to the inductor to maintain a desired temperature of the heating element;

wherein the monitor comprises a current-sense resistor that monitors current supplied to the inductor and wherein the oscillator comprises a synthetic power inductor, configured to change an output frequency of the oscillator and thereby control the energy that is provided to the inductor; and wherein the heating element is a fuel injector valve, the fuel injector valve being coupled to an armature, the armature being coupled to a driver coil.

2. The heated fuel injector driver circuit assembly as recited in claim 1, wherein the converter converts a phase of the current at the inductor into a voltage that is indicative of the phase.

3. The heated fuel injector driver circuit assembly as recited in claim 1, wherein error amplifier combines a current monitored from the current-sense resistor with the voltage value indicative of frequency to obtain a frequency corrected current value.

4. The heated fuel injector driver circuit assembly as recited in claim 3, wherein the frequency-corrected current is differentially amplified relative to a target current value.

5. The heated fuel injector driver circuit assembly as recited in claim 4, wherein a higher frequency-corrected current is indicative of an increase in temperature that triggers a reduction in power provided to the inductor.

6. The heated fuel injector driver circuit assembly as recited in claim 4, wherein a lower frequency-corrected current is indicative of a decrease in temperature that triggers an increase in power provided to the inductor.

* * * * *